United States Patent [19]

Houssian

[11] Patent Number: 4,907,531

[45] Date of Patent: Mar. 13, 1990

[54] DRAWDOWN MACHINES

[76] Inventor: Vazgen J. Houssian, 380 Mountain Rd., Union City, N.J. 07087

[21] Appl. No.: 256,736

[22] Filed: Oct. 12, 1988

[30] Foreign Application Priority Data

Oct. 12, 1987 [GB] United Kingdom ..... 8723921

[51] Int. Cl.[4] ..... B29C 1/06

[52] U.S. Cl. ..... 118/413

[58] Field of Search ..... 118/109, 110, 112, 118–120, 118/122, 123, 106, 126, 71, 236, 238, 407, DIG. 17, 413

[56] References Cited

U.S. PATENT DOCUMENTS 4,644,900 2/1987 Poterala ..... 118/413

4,668,329 5/1987 Shirataki ..... 118/413

*Primary Examiner*—Willard Hoag

*Attorney, Agent, or Firm*—Darby & Darby

[57] ABSTRACT

An improved drawdown machine is disclosed in which an ink bead or coloring agent is evenly distributed over a receptor surface e.g. a sheet of paper by pulling the paper through a nip formed between a bed surface and a bar.

15 Claims, 3 Drawing Sheets

DRAWDOWN MACHINES

FIELD OF THE INVENTION

This invention relates to drawdown machines.

BACKGROUND OF THE INVENTION

One method of applying a colour coating to a receiving surface, for example, a sheet of paper, is to lay the paper on a uniform bed or other flat surface, and pull a bar across the paper surface to apply as a coating a bead of coloured liquid or pasty material which is put on the top of the sheet. The bead is distributed evenly over the paper surface by movement of the bar across the surface.

However, the intensity of colour on the coloured surface obtained may be uneven. This may be due to small irregularities present in the surface under the paper or a non-uniform application of ink to the sheet due to the non-uniform movement of the bar across the paper surface.

In order to overcome this problem, drawdown machines have been developed. These employ adjustable pressure bars which move on specially made drawdown surfaces. These machines are, however, expensive.

GENERAL DESCRIPTION OF THE INVENTION

According to one aspect of the invention, there is provided apparatus for coating a receptor sheet comprising:

sheet support means;

a coating bar arranged to rest on a portion of a sheet on top of the sheet support means and defining a nip therebetween;

a movable sheet clamp for releasably receiving the sheet; and actuation means for effecting movement of the sheet clamp to pull the sheet through the nip.

Advantageously, the sheet support means comprises a narrow bed surface extending across a substantial part of the width of the apparatus, the bed surface being made of a resilient material, for instance foam rubber.

Preferably, the actuation means includes a reciprocating wire loop which carries the sheet clamp. The length of the reciprocating stroke may be limited by the interaction of a rider on the loop and two suitably positioned limit switches. A reversible motor may be used to drive the loop.

A protective sheet may be provided to cover the sheet support means and may be in the form of a non-fibrous mat, an onion skin sheet or newsprint paper. Advantageously, the protective sheet is in the form of a continuous web made from one of the abovementioned materials.

According to a second aspect of the invention, there is provided a drawdown machine for applying a colour coating to a receptor sheet, the machine comprising a narrow bed surface, a bar lying on the bed surface and defining a nip therebetween, a sheet clamp for releasably receiving the sheet and means for reciprocating the sheet clamp to draw the sheet through the nip when moving in one direction and then to return the sheet clamp to its starting position.

DESCRIPTION OF THE DRAWINGS

For a better understanding of the invention, reference will now be made, by way of example only, to the accompanying drawings in which.

Figure 1:
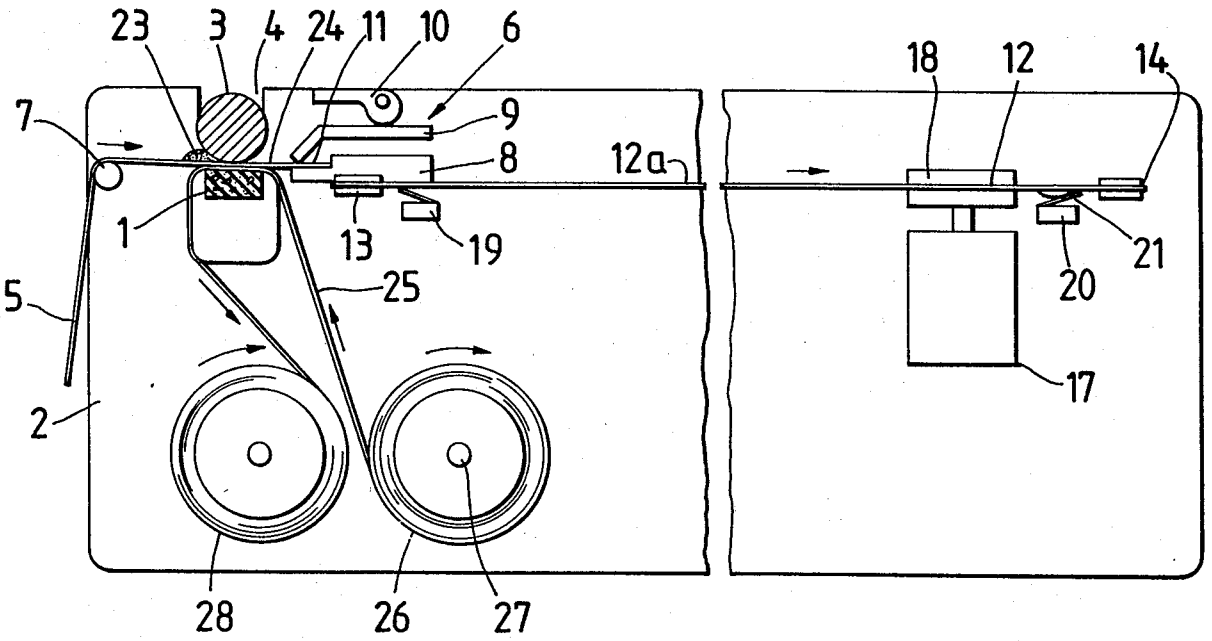
FIG. 1 illustrates a schematic section through a drawdown machine according to the invention.
Figure 2:
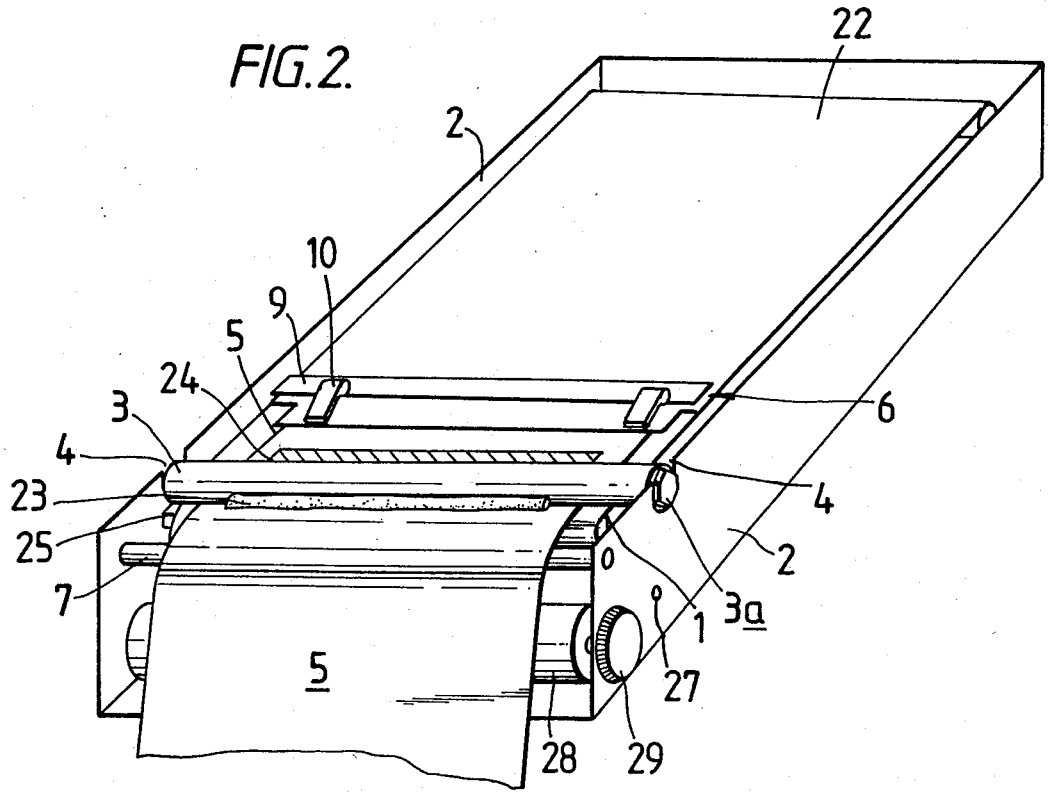
FIG. 2 is a perspective view of a machine as shown in FIG. 1.

In the figures, a narrow, fixed bed surface 1 is mounted between a pair of side frames 2 and extends across the width of the machine. A Meyer bar 3 can rest on the surface 1 when positioned in a pair of slots 4 formed in respective ones of the side frames 2. One end 3*a* of the bar 3 has flats machined on to it so that the bar does not rotate in the slots 4. In the embodiment shown, six flats are formed on the end 3*a*, a pair of diametrically opposed parallel flats engaging with the slot 4 in the associated side frame 2. The bar 3 is a wire-wound bar, the thickness of the wire determining the thickness of the coating applied to the paper - the thicker the wire, the thicker the coating applied. The bar 3 can be removed from the machine by lifting it out of the slots 4. Prior to placing the bar 3 in the slots 4, one end of a sheet of paper 5 which is to be coloured is attached to a clamp 6, the sheet passing over a bar 7 mounted at the near end of the machine, as viewed in FIG. 2.

The clamp 6 comprises a lower portion 8, an upper portion 9 and a pair of pressure-applying levers 10 which when operated press the upper portion 9 against the lower portion 8 to sandwich and hold the sheet 5 along the edge 11. The lower portion 8 of the clamp 6 is attached to a reciprocally movable wire loop 12 which passes round two rollers four idler pulleys 13, 14, 15 and 16. The wire 12 can be driven in either direction by a reversible motor 17 via a drive capstan 18. The range of movement of the wire 12 is limited by the action of a pair of limit switches 19 and 20 positioned below a side portion of the wire and which are operated by an actuator 21 attached to the wire 12. A support surface 22 lies between the portions 12*a* and 12*b* of the wire 12 which extend along the length of the machine. The surface 22 supports the paper 5 as it is drawn through the machine.

The limit switches 19 and 20 are spaced apart to provide a desired reciprocatory stroke for the clamp 6. After the bar has been placed in slots 4 to rest on the paper 5, an ink bead 23 is applied to the upper surface of the paper 5 adjacent the bar 3 i.e. across the width of the machine. The ink bead 22 is on the side of the bar 3 from clamp 6. The motor is then actuated e.g. by a suitable switch and as the paper is drawn under the bar 3 the ink bead is distributed over the upper surface 24 of the paper 5.

The bed surface 1 can be protected by a continuous web 25 of protective material which passes over the bed surface 1, passing between it and the paper 5. The web 25 is unwound from a stock roll 26 mounted on an axis 27 and wound onto a waste roll 28 having knob 29 and which is advanced manually after each drawdown operation. The protective material may be a non-fibrous mat, an onion skin sheet or newsprint paper.

After all of the sheet 5 has been drawn through the machine i.e. between the bar 3 and the bed surface 1 preferably after drying and the edge 11 can be removed from the clamp 6 whilst the paper 5 is supported by the surface 22. Once released, the sheet 5 can be removed from the machine.

The wire loop 12 can then be moved back so that the clamp 6 is in a position adjacent the bed surface 1 ready to receive the next sheet of paper to be coated.

A control box (not shown) can be used to return the clamp 6 prior to the next operation. It may also include means for varying the speed of the motor 17 e.g. a rheostat, both during the coating operation and on returning the clamp 6 to its 'start' position adjacent the bed surface 1. For example, the speed of the motor driving the coating process may be relatively slow in comparison to the return speed of the clamp.

The bed surface 1 may be made of a hard foam rubber or similar material.

The ink bead 23 may be replaced by any fluid which is required to be evenly distributed over a receiving surface.

Instead of a wire loop, the clamp could be moved by a pair of chains, one positioned at each end of the clamp.

Figure 3:
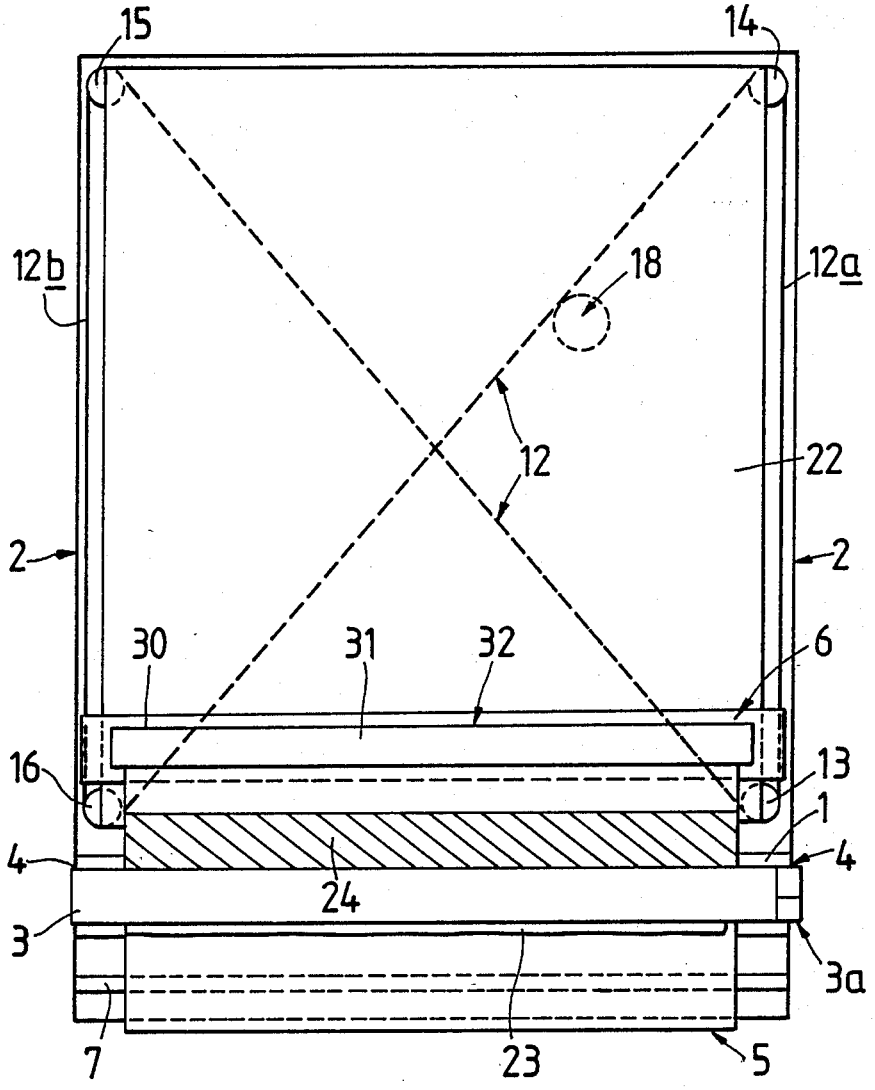
FIG. 3 is a plan view of the machine of FIG. 1.

An alternative clamp 6 is shown in FIG. 3. It comprises a metal plate 30 and a magnetic strip 31, the strip 31 being attached to the plate 30 so that it can pivot along a long edge 32 to grip the edge 11 of the paper 5.

Advantageously, the web 25 may also pass over the surface 22 to provide it with a protective layer. In such a case, the stock roll 26 may be positioned at the rear of the machine i.e. remote from the bed 1.

I claim:

1. Apparatus for coating a receptor sheet comprising:
sheet support means;
a coating bar arranged to rest on a portion of a sheet on top of the sheet support means to define a nip therebetween;
a movable sheet clamp for releasably receiving the sheet; and
actuation means for effecting movement of the sheet clamp to pull the sheet through the nip.

2. The apparatus of claim 1, wherein the sheet support means comprises a narrow bed surface extending across a substantial part of the width of the apparatus.

3. The apparatus of claim 2, wherein the bed is surfaced with resilient foam material.

4. The apparatus of claim 1, wherein the actuation means includes a reciprocatable wire loop which carries the sheet clamp.

5. The apparatus of claim 4, and including two limit switches and circuitry connected therewith to limit the length of the stroke of the reciprocatable wire loop in dependence on the separation of two limit switches.

6. The apparatus of claim 4, the wire loop being arranged about four idler pulleys and connected to a reversible drive motor via a capstan drive.

7. The apparatus of claim 1, the sheet clamp being disposed to grip at least a substantial portion of an edge of the receptor sheet.

8. The apparatus of claim 1, wherein the sheet clamp comprises a metal plate to which a magnetic strip is attached for gripping the receptor sheet.

9. The apparatus of claim 1, and including a protective sheet constituting the upper surface of the sheet support means.

10. The apparatus of claim 9, wherein the protective sheet is a non-fibrous mat.

11. The apparatus of claim 9, wherein the protective sheet is an onion skin sheet.

12. The apparatus of claim 9, wherein the protective sheet is newsprint paper.

13. The apparatus of claim 9, wherein the protective sheet is in the form of a continuous web which is wound from a stock roll on to a waste roll over the sheet support means.

14. The apparatus of claim 13, and including means for manually indexing the continuous web at the end of each operation of the apparatus.

15. A drawdown machine for applying a coating to a receptor sheet, the machine comprising a narrow bed surface, a bar lying on the bed surface and defining a nip therebetween, a sheet clamp releasably receiving the sheet and means for reciprocating the sheet clamp to draw the sheet through the nip when moving in one direction and then to return the sheet clamp to its starting position.

* * * * *